US008089222B2

(12) United States Patent
Oki et al.

(10) Patent No.: US 8,089,222 B2
(45) Date of Patent: Jan. 3, 2012

(54) FAST ELECTROMAGNET DEVICE

(75) Inventors: Toshiyuki Oki, Ibaraki (JP); Takahisa Itahashi, Osaka (JP); Yoshitaka Kuno, Osaka (JP)

(73) Assignee: Osaka University, Osaka (JP)

( * ) Notice: Subject to any disclaimer, the term of this patent is extended or adjusted under 35 U.S.C. 154(b) by 440 days.

(21) Appl. No.: 12/518,704

(22) PCT Filed: Jul. 4, 2007

(86) PCT No.: PCT/JP2007/063338

§ 371 (c)(1),
(2), (4) Date: Jun. 11, 2009

(87) PCT Pub. No.: WO2008/072394

PCT Pub. Date: Jun. 19, 2008

(65) Prior Publication Data

US 2010/0060206 A1 Mar. 11, 2010

(30) Foreign Application Priority Data

Dec. 12, 2006 (JP) ..... 2006-334739

(51) Int. Cl.
*H05H 7/04* (2006.01)

(52) U.S. Cl. ..... 315/500; 315/5.41

(58) Field of Classification Search ..... 315/500, 315/5.41, 5.42, 5.43, 5.39, 501, 502, 503, 315/505, 506

See application file for complete search history.

(56) References Cited

U.S. PATENT DOCUMENTS 5,355,106 A * 10/1994 Nakata et al. ..... 335/212
5,436,537 A * 7/1995 Hiramoto et al. ..... 315/507
5,917,293 A 6/1999 Saito et al.
7,741,781 B2 * 6/2010 Nagayama et al. ..... 315/5.41

FOREIGN PATENT DOCUMENTS

JP 9-161997 6/1997
JP 2000-331829 11/2000

OTHER PUBLICATIONS

International Search Report issued Sep. 25, 2007 in the International (PCT) Application of which the present application is the U.S. National Stage.
Eiji Nakamura et al., "3Gev Kicker Saiko", Accelerator Study Note, ASN-455, Dec. 6, 2001, Zen 4P.
Tadamichi Kawakubo, "Blumlein o Riyo shita Atarashii Kosoku Kojiba Hassei-yo Kicker Magnet System", Accelerator Study Note, ASN-305, Jul. 2, 1990, Zen 10P.
KEK-76-21, Koji Takata et al., "Full Aperture Kicker Magnets for KEK Proton Synchrotron", Mar. 1977, pp. 1-26 (with its partial English translation).
A Reply (First) submitted in International Application No. PCT/JP2007/063338 and its English translation submitted on Nov. 1, 2007.

* cited by examiner

*Primary Examiner* — David Hung Vu
(74) *Attorney, Agent, or Firm* — Wenderoth, Lind & Ponack, LLP

(57) ABSTRACT

A fast electromagnet device (140) receives a high voltage from a pulse power supply through a coaxial cable and excites an electromagnet at high speed, so as to bend a charged particle beam. The fast electromagnet device (140) includes a kicker magnet (150) and an auxiliary circuit (160). The kicker magnet (150) is equivalent to a circuit element of a lumped constant circuit, is formed with a space penetrating in the traveling direction of the charged particle beams, instantaneously generates a magnetic field in the penetrated space with a high voltage applied, and bends the charged particle beams passing through the penetrated space. The auxiliary circuit (160) constitutes a matching circuit in combination with the kicker magnet (150), so that the input impedance of the matching circuit and the characteristic impedance of the coaxial cable connected to the input terminal of the matching circuit are matched.

4 Claims, 10 Drawing Sheets

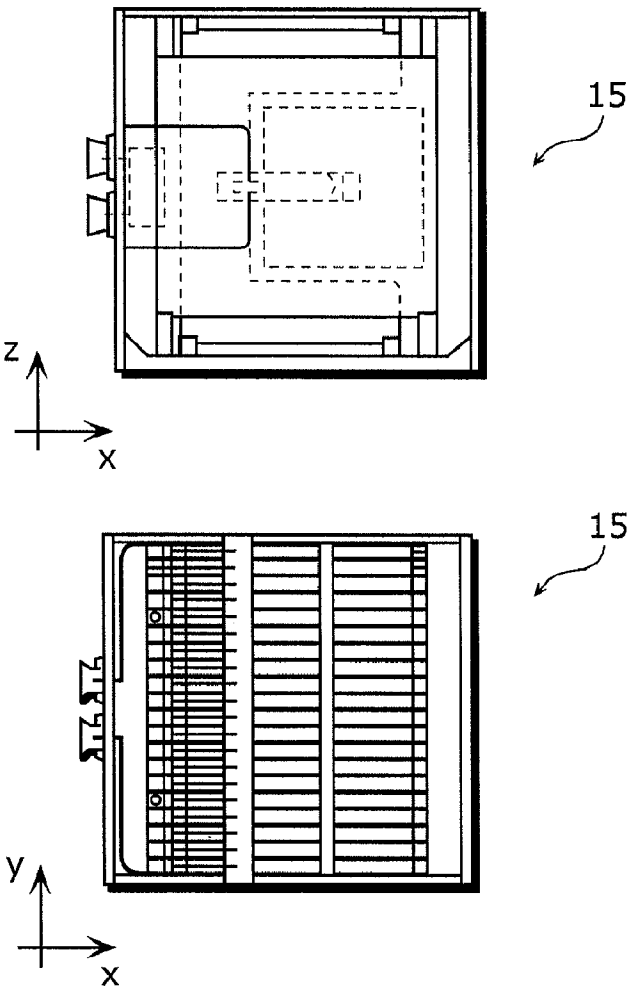
FIG. 1
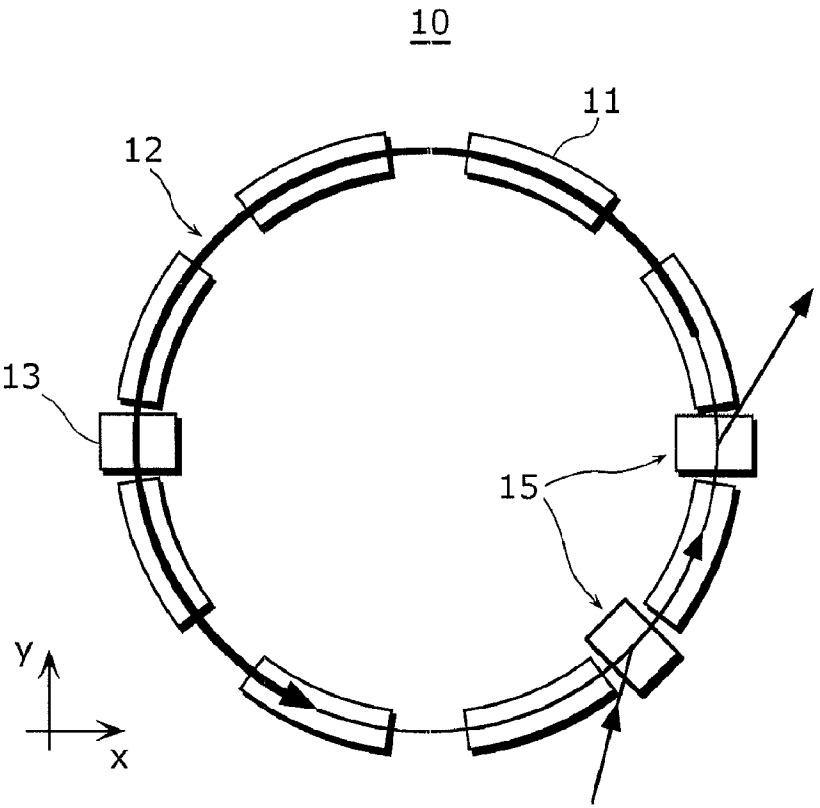

FAST ELECTROMAGNET DEVICE

TECHNICAL FIELD

The present invention relates to a fast electromagnet device which applies, to a charged particle beam, a magnetic field generated by instantaneously exciting an electromagnet, so as to inject the charged particle beam into a circular accelerator, or to eject the charged particle beam from the circular accelerator.

BACKGROUND ART

Conventional kicker magnets used in circular accelerators, such as synchrotrons, are designed as several circuit elements constituting distributed constant circuits (for example, see non-patent document 1). Here, the kicker magnets are electromagnets used when charged particle beams are injected to circular accelerator rings, or the charged particle beams are ejected from the circular accelerator rings.

FIG. 1 is a diagram schematically illustrating a circular accelerator including conventional kicker magnets. As shown in FIG. 1, in a circular accelerator 10 such as a synchrotron, several bending magnets 11, arranged in a ring, generate magnetic fields for bending a charged particle beam 12. Furthermore, a radio frequency accelerator 13, arrange in a part of the ring, circumferentially generates a radio frequency accelerating electric field. With this, the charged particle beam 12 accelerates as it circulates around an orbital path repeatedly. At this time, the radio frequency accelerating electric field also acts as a restoring force. Thus, the charged particle beam 12 localizes and circulates along the ring of the circular accelerator 10 while forming a cluster called a bunch. After sufficient acceleration, the charged particle beam localizing and circulating along the ring, that is, a bunched charged particle beam (hereinafter, referred to as a beam bunch) is ejected from the ring with a fast beam extraction method and the like.

In the fast beam extraction method, the kicker magnet 15 for ejection is excited at high speed in order to eject the beam bunch 12 from the ring. At this time, the kicker magnet 15 for ejection generates a magnetic field which rises at around 50 to 200 nsec, and has a magnetic field strength of around 20 to 50 mT. This is because the kicker magnet 15 for ejection needs to have fast response characteristics and to generate a magnetic field having a sufficient strength, in order to bend the beam bunch 12 which is in a high energy state made by being accelerated by the circular accelerator 10.

FIG. 2 is a diagram schematically illustrating a fast electromagnet device including a conventional kicker magnet. As shown in FIG. 2, a fast electromagnet device 14 excites the kicker magnet 15 for ejection, provided at the straight section of the ring of the circular accelerator 10, at high speed. Here, as an example, the fast electromagnet device 14 includes a pulse power supply 21, a coaxial cable 22, the kicker magnet 15 for ejection (hereinafter, referred to as kicker magnet 15), a terminating resistor 23, and the like. The output terminal of the pulse power supply 21 and the input terminal of the kicker magnet 15 are connected each other through the coaxial cable 22. The output terminal of the kicker magnet 15 is connected to one end of the terminating resistor 23. The other end of the terminating resistor 23 is grounded.

Further, the pulse power supply 21 includes a DC charge power supply, Pulse Forming Network (PFN), a thyratron, and the like. In order to excite the kicker magnet 15, the thyratron is fired after the PFN is charged in advance by the DC charge power supply, so that a high voltage is outputted.

This causes a high voltage having a pulse waveform (hereinafter, referred to as pulsed voltage) to be applied to the kicker magnet 15 from the pulse power supply 21 through the coaxial cable 22 which is one kind of transmission lines. As a result, as shown in a waveform 33, a current having a pulse waveform (hereinafter, referred to as pulsed current) flows, thereby driving the kicker magnet 15.

At this time, it is necessary for the fast electromagnet device 14 to start excitation of the kicker magnet 15 immediately after a predetermined beam bunch passes through the kicker magnet 15, complete the excitation of the kicker magnet 15 before the next beam bunch reaches the kicker magnet 15, and generate a predetermined magnetic field. In other words, the time period t which is necessary for generating the magnetic field at the kicker magnet 15, needs to be designed to be less than the time difference between the beam bunches.

In general, the number of the beam bunches existing around the ring of the circular accelerator 10 and the time difference between the beam bunches, are determined by the design or driving parameter of the circular accelerator 10. Typically, the number of the beam bunches is in the range from one to several thousand, and the time difference between the beam bunches is in the rage from several dozen to several hundred nsec. Therefore, as shown in a waveform 32, as a rise time for excitation of the kicker magnet 15, a response characteristic approximately ranging from several dozen to several hundred nsec is required. Here, in a waveform 31, the horizontal axis represents time, and the vertical axis represents intensity of beam bunch measured at the position where the kicker magnet 15 is provided. Further, in the waveform 32, the horizontal axis represents time, and the vertical axis represents strength of the magnetic field of the kicker magnet 15.

As described, since the fast electromagnet device 14 is required to have fast response characteristics, it is necessary to prevent reflection of current flowing through the kicker magnet 15 from occurring. Thus, it is necessary to match the input impedance of the kicker magnet 15 and the characteristic impedance of the coaxial cable 22 such that they become equal to each other. However, the characteristic impedance of the coaxial cable 22 is usually treated as a pure resistance, and is independent of frequency. On the other hand, it is assumed that the kicker magnet 15 is designed as one of the circuit elements, such as a coil, constituting a lumped constant circuit. In this case, the input impedance of the kicker magnet 15 becomes a function of frequency, and cannot be matched with the characteristic impedance of the coaxial cable 22. Thus, the kicker magnet 15 is designed as several circuit elements constituting a distributed constant circuit FIG. 3 is a diagram schematically illustrating a conventional kicker magnet. As shown in FIG. 3, as an example, the kicker magnet 15 includes several units each having a magnetic core 15*d*, and electrode plates 15*a*, 15*b*, and 15*c* which sandwich the magnetic core 15*d*, and is designed as circuit elements 16*a*, 16*b*, and 16*d* constituting the distributed constant circuit. This results in making the input impedance of the kicker magnet 15 constant only in the band equal to or lower than a predetermined cutoff frequency, without depending on frequency. Then, it is possible to perform a matching with respect to a major component among high-frequency component of the current flowing through the kicker magnet 15.

Non Patent Document 1: KEK-76-21, K. Takata, S. Tazawa, and Y. Kimura, "FULL APERTURE KICKER MAGNETS FOR KEK PROTON SYNCHROTRON." (1977).

DISCLOSURE OF INVENTION

Problems that Invention is to Solve

However, the pulsed current (waveform 33) flowing through the kicker magnet 15 includes high-frequency components in which amplitude is small but frequency is higher than cutoff frequency; and therefore, it is not possible to perform a matching with respect to such high-frequency components. As a result, reflection of the high-frequency components included in the pulsed current occurs, causing dielectric breakdown.

For example, there is a case that, out of fifty six coaxial cables (65 kV withstanding voltage) connected to several kicker magnets 15 provided in the circular accelerator 10, thirteen of them (23%) had to be replaced within one year. As described, for using the kicker magnet 15, such a problem exists that stable driving for a long period of time is difficult. Furthermore, there is also a problem that maintenance work is required which involves radiation exposure.

Furthermore, in the kicker magnet 15, the electrode plates 15*a*, 15*b*, and 15*c* sandwich the magnetic core 15*d*; and thus application of high voltage may cause discharge between the electrode plates. In order to avoid this, the whole kicker magnet 15 needs to be contained in a vacuum case.

Furthermore, the straight section of the ring of the circular accelerator 10 on which the kicker magnet 15 is provided, is restricted in length. This also causes a problem in that the size of the kicker magnet 15 is further restricted since it needs to be contained in the vacuum case.

Furthermore, since a magnetic body which has poor vacuum characteristics is inserted into the vacuum portion of the ring of the circular accelerator 10, such a problem occurs that gas generated by the magnetic body deteriorates the vacuum state, causing beam loss.

Furthermore, since the kicker magnet 15 is contained in the vacuum case, a pulse feedthrough is provide to the vacuum case so as to introduce current to the kicker magnet 15. Since impedance matching and withstanding voltage are necessary in the pulse feedthrough, processing with a very high level of precision is required, which is very expensive. As described, due to conditions such as impedance matching, high withstanding voltage, vacuum, and the like, there is also a problem that production and selection of constituting elements such as ferrite, adhesive, pulse feedthrough, and capacitor are difficult.

The present invention has been conceived in view of the above problems, and has an object to provide a fast electromagnet device which prevents occurrence of reflection in all frequency bands, has a simple structure and requires simple maintenance.

Means to Solve the Problems

In order to achieve the above object, the fast electromagnet device according to the present invention (a) receives a high voltage pulse from a pulse power supply through a transmission line and excites an electromagnet at high speed, so as to bend a charged particle beam. The fast electromagnet device may include: (a1) an electromagnet which is formed with a space penetrating in a traveling direction of the charged particle beam, and instantaneously generates a magnetic field in the space with the high voltage pulse applied, so as to bend the particle beam passing through the space, the electromagnet being equivalent to a circuit element of a lumped constant circuit; and (a2) an auxiliary circuit which constitutes a matching circuit in combination with the electromagnet, so that an input impedance of the matching circuit and a characteristic impedance of the transmission line connected to an input terminal of the matching circuit are matched.

With this, it is possible to provide impedance matching between the matching circuit (lumped constant circuit) configured by combining the electromagnet and the auxiliary circuit, and the transmission line. As a result, it is possible to perfectly prevent reflection from occurring. Therefore, destructive failure due to reflection can be avoided as much as possible, stable driving for a long period of time can be expected, and maintenance work involving radiation exposure can be reduced.

Effects of the Invention

According to the present invention, even though an electromagnet is designed as one of circuit elements constituting a lumped constant circuit, constant input impedance can be performed in principle in all frequency bands by combining the electromagnet and an auxiliary circuit. Thus, a perfect matching can be performed between the matching circuit (lumped constant circuit) configured by combining the electromagnet and the auxiliary circuit, and the transmission line, which makes is possible to perfectly prevent reflection from occurring. Therefore, destructive failure due to reflection can be avoided as much as possible, stable driving for a long period of time can be expected, and maintenance work involving radiation exposure can be reduced.

Furthermore, the electromagnet and the auxiliary circuit according to the present invention can be separately mounted. Therefore, it is possible to use, as a circuit element for the auxiliary circuit, a component which is inexpensive and large in size. This facilitates production and selection of circuit elements, for example, easing of the conditions for withstanding voltage.

Furthermore, the electromagnet according to the present invention has a simpler structure compared to conventional electromagnets, requires a significantly reduced number of components, and the design can be greatly simplified.

Furthermore, in the electromagnet according to the present invention, a magnetic core does not need to be sandwiched by electrode plates, and the electromagnet does not need to be contained in a vacuum case in consideration of discharge between the electrode plates. Thus, the electromagnet according to the present invention does not require the vacuum case which is absolutely necessary for conventional electromagnets. This makes it possible to make effective use of a straight section of the ring of the circular accelerator, which is restricted in installation space. Furthermore, a component which requires very high level of precision, such as a terminal provided to the vacuum case, is not necessary. Moreover, since a magnetic core which causes deterioration of vacuum characteristics can be provided in the air, it is possible to maintain a high vacuum state of the ring of the circular accelerator in which the charged particle beam circulate, and to avoid unnecessary loss of the charged particle beam.

BRIEF DESCRIPTION OF DRAWINGS

FIG. 1 is a diagram schematically illustrating a circular accelerator including conventional kicker magnets.

NUMERICAL REFERENCES

Figure 2:
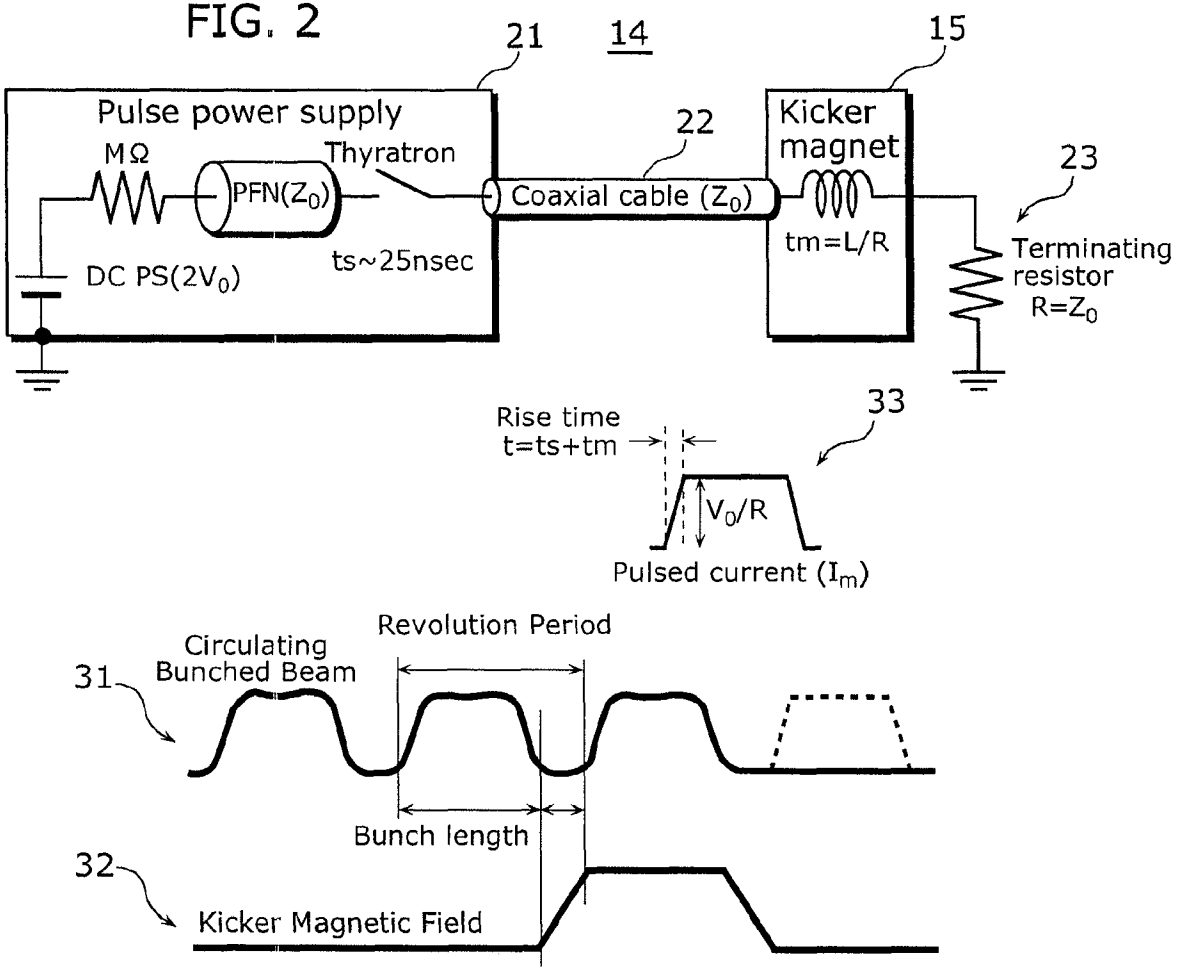
FIG. 2 is a diagram schematically illustrating a fast electromagnet device including a conventional kicker magnet.
Figure 3:
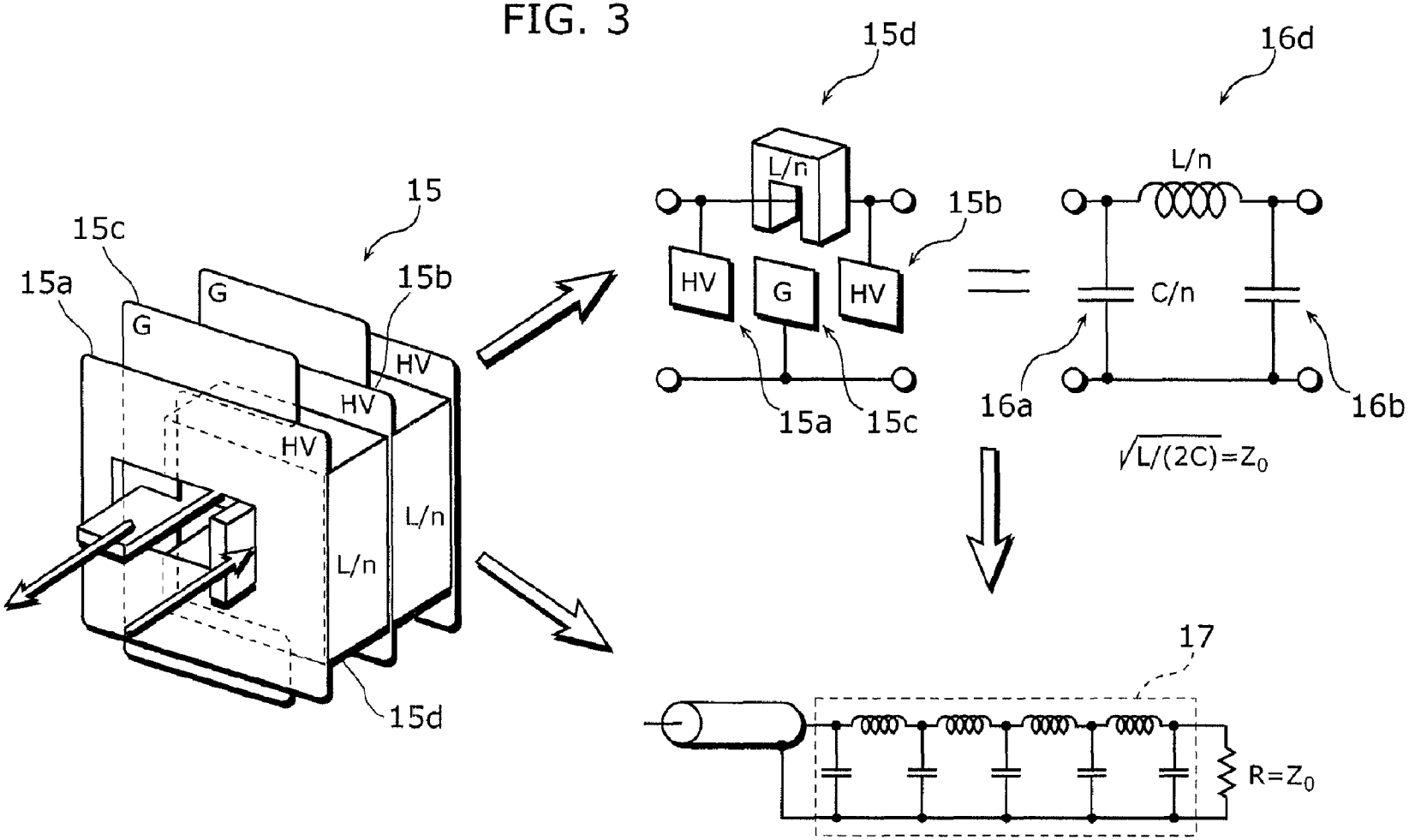
FIG. 3 is a diagram schematically illustrating a conventional kicker magnet.

10 Circular accelerator
11 Bending magnet
12 Charged particle beam (beam bunch)
13 Radio frequency accelerator
14 Fast electromagnet device
15 Kicker magnet
17 Excitation circuit
21 Pulsed power supply
22 Coaxial cable
23 Terminating resistor
15*a*, 15*b*, 15*c* Electrode plate
15*d* Magnetic core
16*a*, 16*b* Circuit element (Capacitor)
16*d* Circuit element (Inductor)
100 Accelerator
140 Fast electromagnet device
150 Kicker magnet (circuit element Z1)
151 Magnetic body
152, 153 Conductor
154 Duct
155 Injection hole
156 Ejection hole
160 Auxiliary circuit
161 Capacitor (Circuit element Z2)
162 Capacitor (Circuit element Z3)
163 Coil (Circuit element Z4)
170 Four-terminal circuit
171, 172 Input terminal
173, 174 Output terminal

BEST MODE FOR CARRYING OUT THE INVENTION

Embodiment

Hereinafter, an embodiment according to the present invention will be described with reference to the drawings.

A fast electromagnet device according to the present embodiment includes features (a) to (c) described below.

(a) The fast electromagnet device which receives a high voltage pulse from a pulse power supply through a transmission line and excites an electromagnet at high speed, so as to bend a charged particle beam, includes: (a1) an electromagnet which is formed with a space penetrating in a traveling direction of the charged particle beam, and instantaneously generates a magnetic field in the space with the high voltage pulse applied, so as to bend the particle beam passing through the space, the electromagnet being equivalent to a circuit element of a lumped constant circuit; and (a2) an auxiliary circuit which constitutes a matching circuit in combination with the electromagnet, so that an input impedance of the matching circuit and a characteristic impedance of the transmission line connected to an input terminal of the matching circuit are matched.

(b) (b1) The electromagnet includes: a coil having one end connected to the pulse power supply through the transmission line; and a magnetic core, and (b2) the auxiliary circuit includes: (b2-1) a first circuit element having one end connected to the one end of the coil; (b2-2) a second circuit element having one end connected to the other end of the coil; (b2-3) a third circuit element having one end connected to the other end of the first circuit element and to the other end of the second circuit element; and (b2-4) a terminating resistor having one end connected to the other end of the coil, and having the other end connected to the other end of the third circuit element.

(c) when a resistance value of the terminating resistor is R, and an impedance of the electromagnetic is Z, (c1) an impedance of the first circuit element is given by $2R^2/Z$, (c2) an impedance of the second circuit element is given by $2R^2/Z$, and (c3) an impedance of the third circuit element is given by $Z/4$.

In view of the above points, the fast electromagnet device according to the present invention will be described.

Figure 4:
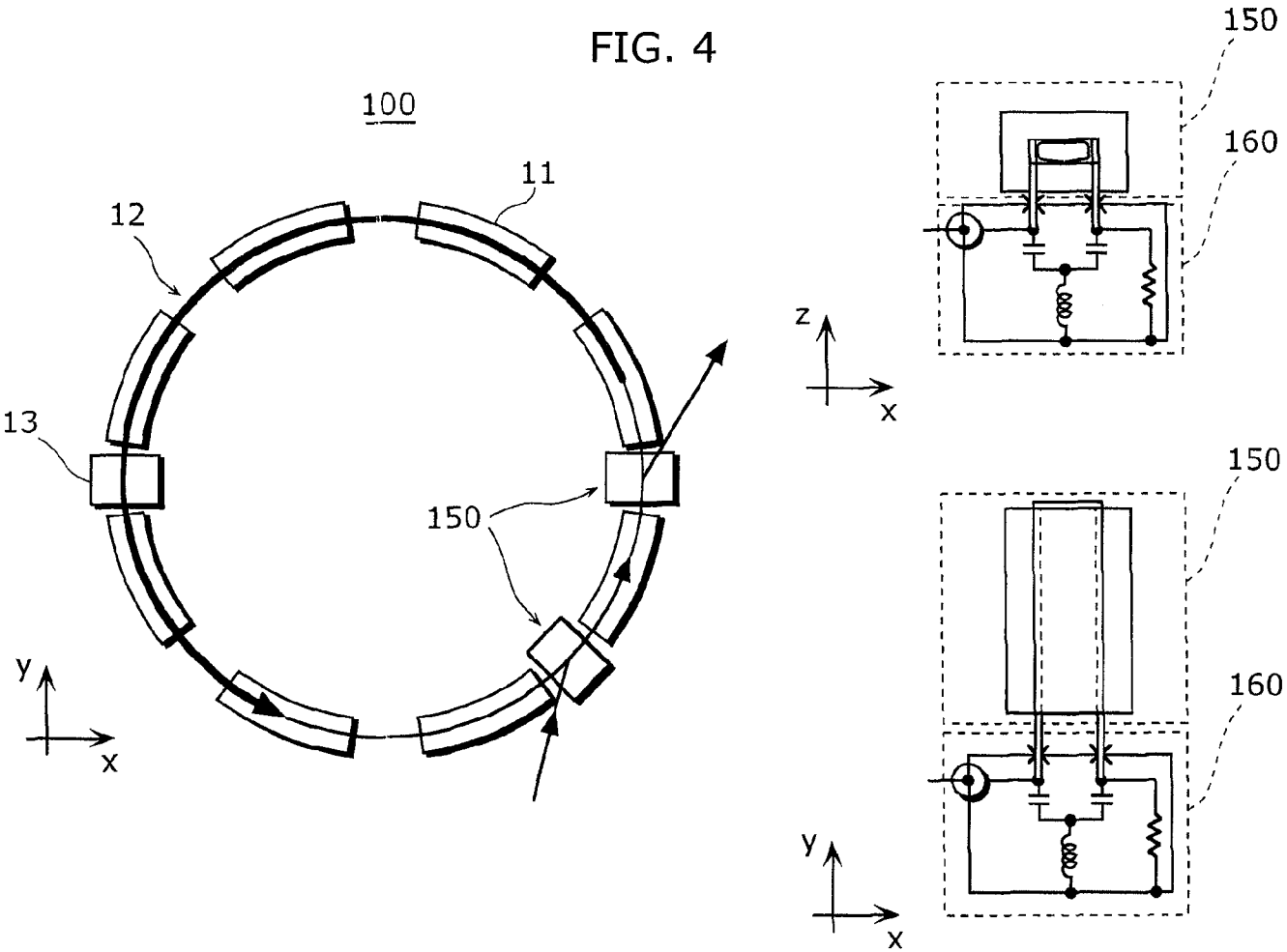
FIG. 4 is a diagram schematically illustrating a circular accelerator including a kicker magnet according to an embodiment of the present invention.

FIG. 4 is a diagram schematically illustrating a circular accelerator including kicker magnets according to the present embodiment. As shown in FIG. 4, a circular accelerator 100 is provided with several bending magnets 11 arranged in a ring. The kicker magnet 150 for injection is provided at the injection position of the charged particle beam 12, and the kicker magnet 150 for ejection is provided at the ejection position of the charged particle beam 12, of the spaces between the bending magnets 11, that is, the straight sections of the ring of the circular accelerator 100.

The charged particle beam 12 (hereinafter, referred to as beam bunch 12) for a predetermined time period is injected into the ring of the circular accelerator 100 by the kicker magnet 150 for injection. The injected beam bunch 12 is bent by the several bending magnets 11, and repeatedly circulates around an orbital path. The beam bunch 12 accelerates while repeatedly circulating, and after sufficient acceleration, the beam bunch 12 is extracted by the kicker magnet 150 for ejection.

Here, the kicker magnets 150, provided at the injection position and the ejection position, have simpler structures compared to the kicker magnets 15, and are configured of a coil and a magnetic body (such as a ferrite). The kicker magnet 150 is equivalent to one of circuit elements constituting a lumped constant circuit Furthermore, by combining the kicker magnet 150 with an auxiliary circuit 160, a circuit is constituted having impedance matched to the driving systems for driving the kicker magnet 150.

It is to be noted that the kicker magnet 150 and the auxiliary circuit 160 can be separately provided. This makes it possible to make effective use of the straight section of the ring of the circular accelerator 100, which is restricted in installation space. Here, as an example, the kicker magnet 150 is provided at the straight section having a length of 0.2 to 0.5 m approximately.

Figure 5:
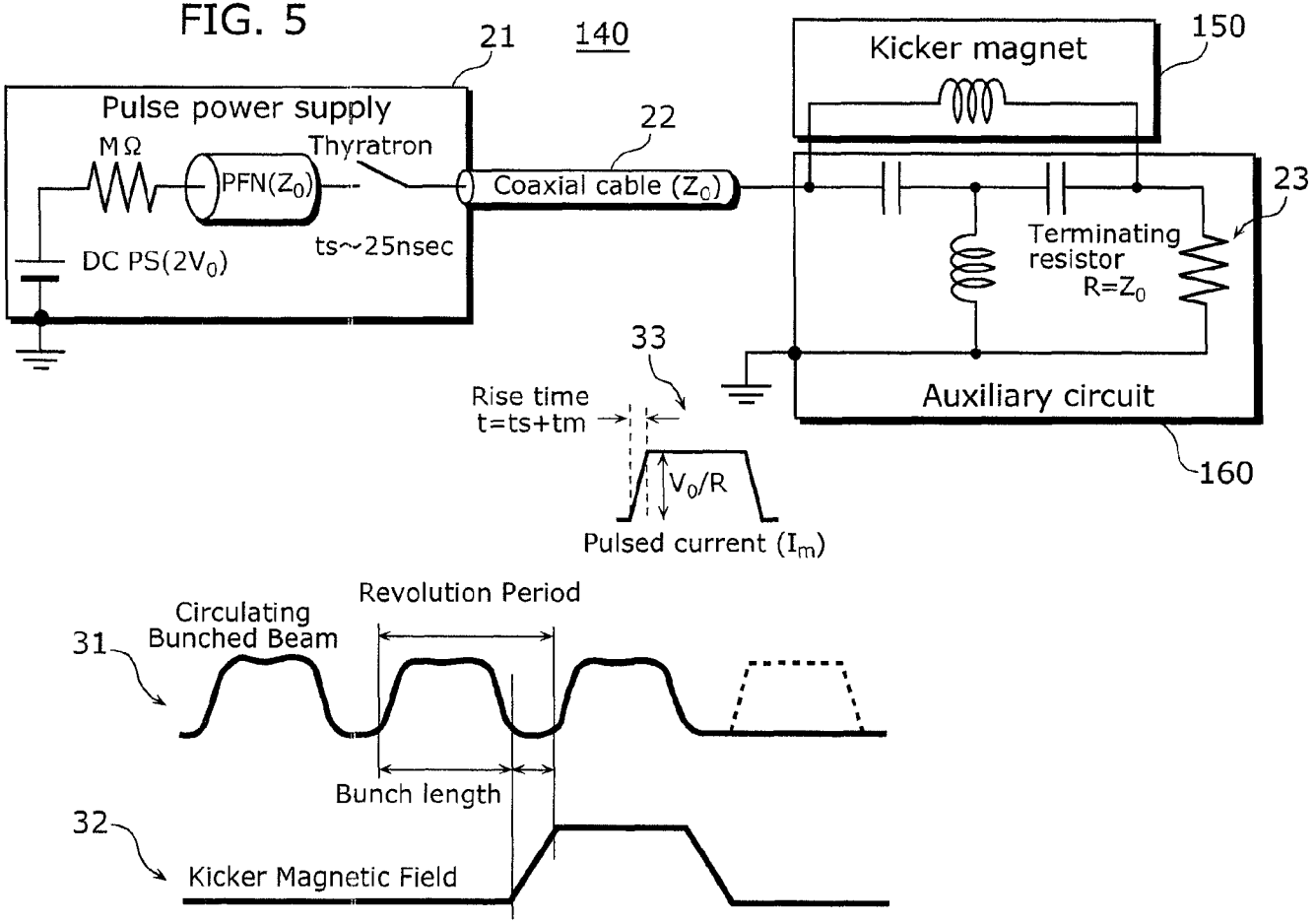
FIG. 5 is a diagram schematically illustrating a fast electromagnet device including a kicker magnet according to an embodiment of the present invention.

FIG. 5 is a diagram schematically illustrating a fast electromagnet device including the kicker magnet 150 according to the present embodiment. As shown in FIG. 5, as an example, a fast electromagnet device 140 includes the kicker magnet 150 and the auxiliary circuit 160. The fast electromagnet device 140 also includes a pulse power supply, a coaxial cable and the like, as in a conventional fast electromagnet device 14 (see FIG. 2, for example). The pulse power supply 21 includes a DC charge power supply, a Pulse Forming Network (PFN), a thyratron, and the like. In order to excite the kicker magnet 150, the thyratron is fired after the PFN is charged in advance by the DC charge power supply, so that a high voltage is outputted. This causes a high voltage having a pulse waveform (hereinafter, referred to as pulsed voltage) to be applied to the kicker magnet 150 from the pulse power supply through the coaxial cable 22 which is one kind of transmission lines, and a pulsed current flows, thereby driving the kicker magnet 150. In such a manner, the fast electromagnet device 140 excites the kicker magnet 150 provided at the straight section of the ring of the circular accelerator 100 at high speed.

Figure 6:
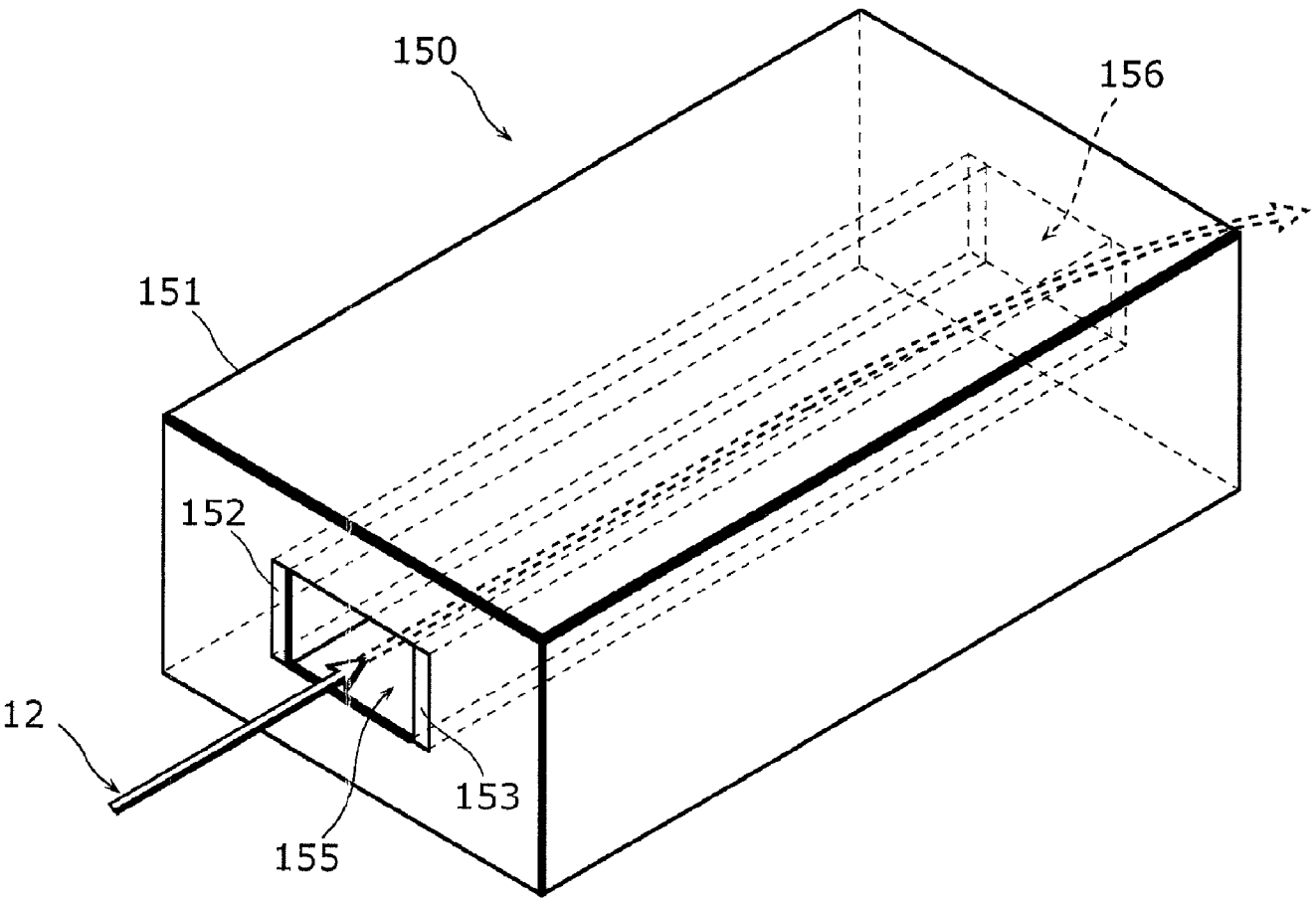
FIG. 6 is a perspective view of a kicker magnet according to an embodiment of the present invention.
Figure 7:
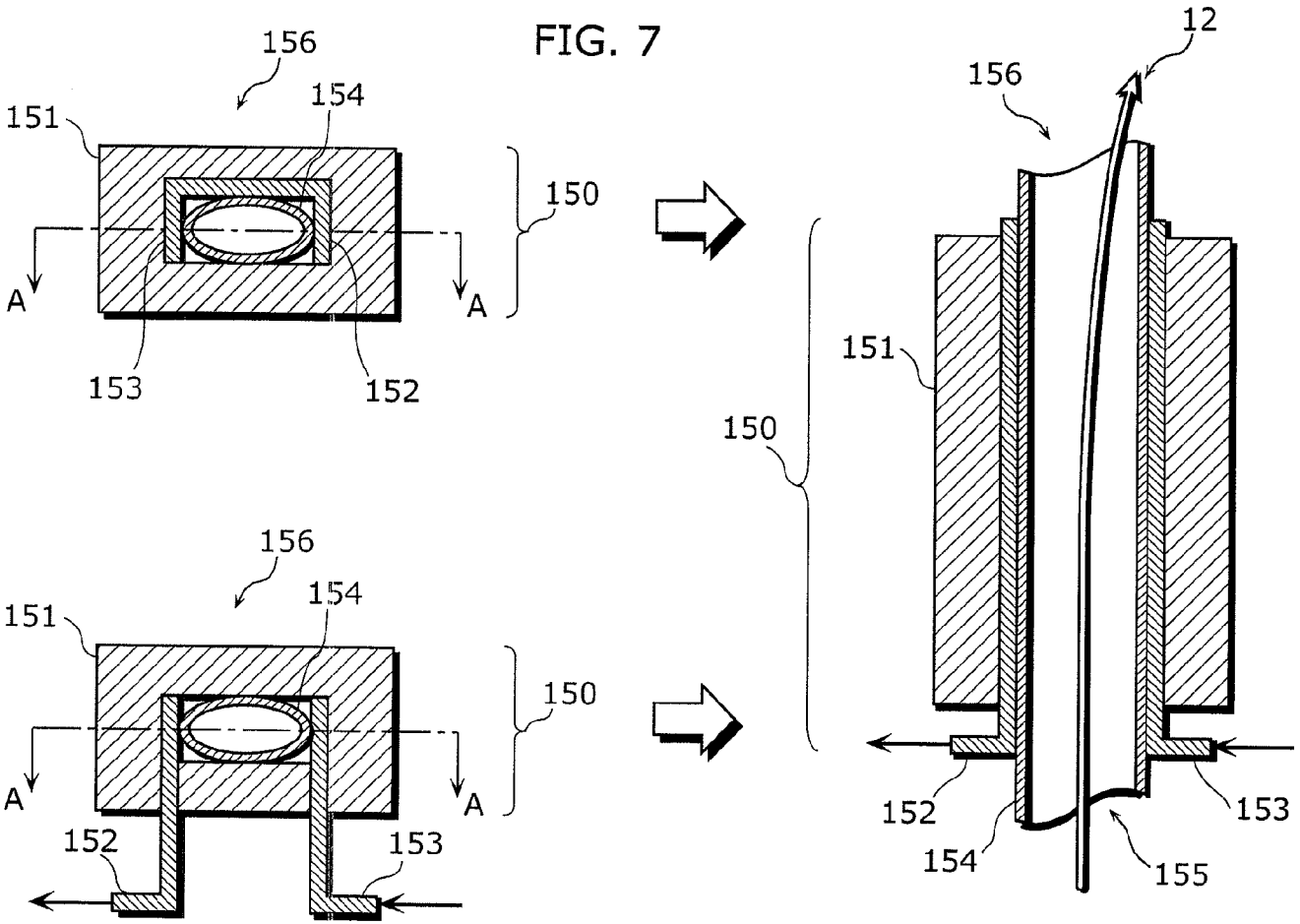
FIG. 7 are a lateral view of the kicker magnet according to the present invention as viewed from the injection hole, a lateral view as viewed from the ejection hole, and a cross sectional view taken along from line A to A as viewed in the arrow direction.

FIG. 6 is a perspective view schematically illustrating the kicker magnet 150 according to the present embodiment. FIG. 7 are a lateral view of the kicker magnet 150 according to the present invention as viewed from an injection hole 155, a lateral view as viewed from an ejection hole 156, and a cross sectional view taken along from line A to A as viewed in the arrow direction. As shown in FIG. 6 and FIG. 7, the kicker magnet 150 has a magnetic body 151 formed with a space penetrating in the traveling direction of the beam bunch 12. Further, the magnetic body 151 has an inside provided with conductors 152 and 153 through which current having a pulse waveform (hereinafter, referred to as pulsed current) flows. Here, the conductors 152 and 153 are short-circuited at the ejection hole 156. Further, with the ceramic duct 154 inserted into the penetrated space, the kicker magnet 150 is provided at the straight section of the ring of the circular accelerator 100.

It is assumed that the beam bunch 12 passes through the inside of the duct 154 in which vacuum is formed in advance, and pulsed current is applied at the exact time when the beam bunch 12 is injected from the injection hole 155. In this case, the kicker magnet 150 generates a strong magnetic field in a vertical direction with respect to the traveling direction of the beam bunch 12, bends the beam bunch 12, and ejects the beam bunch 12 through the ejection hole 156.

When pulsed current flowing in the direction from the conductor 153 to the conductor 152 is applied, the kicker magnet 150 generates a strong magnetic field in a vertical direction (upward) with respect to the traveling direction of the beam bunch 12. When pulsed current is applied in a reverse direction, the kicker magnet 150 generates a strong magnetic field in a reverse direction and bends the beam bunch in a reverse direction.

Figure 8A:
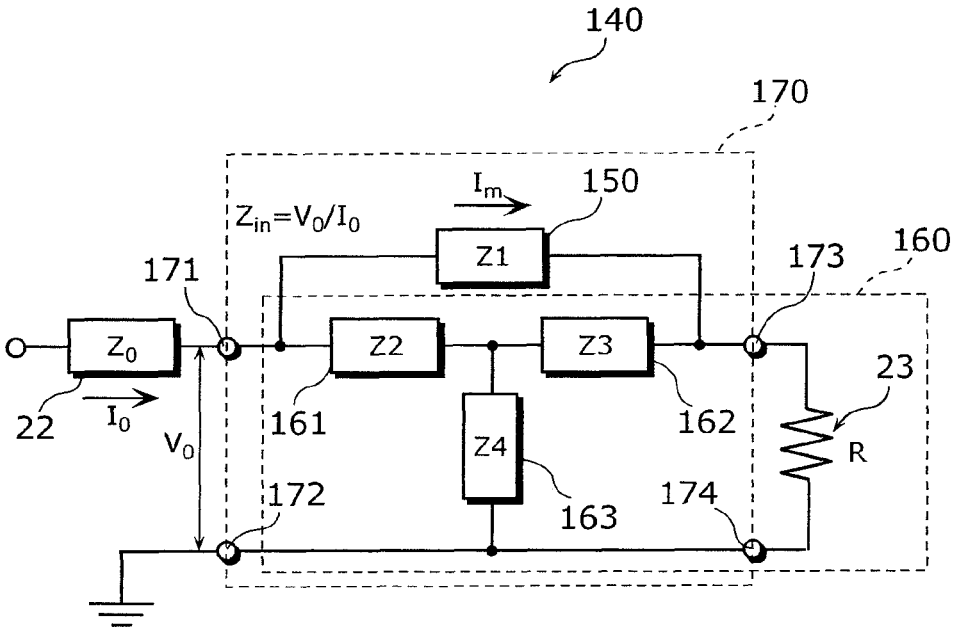
FIG. 8A is a first diagram schematically illustrating a circuit configured of a kicker magnet and an auxiliary circuit according to an embodiment of the present invention.
Figure 8B:
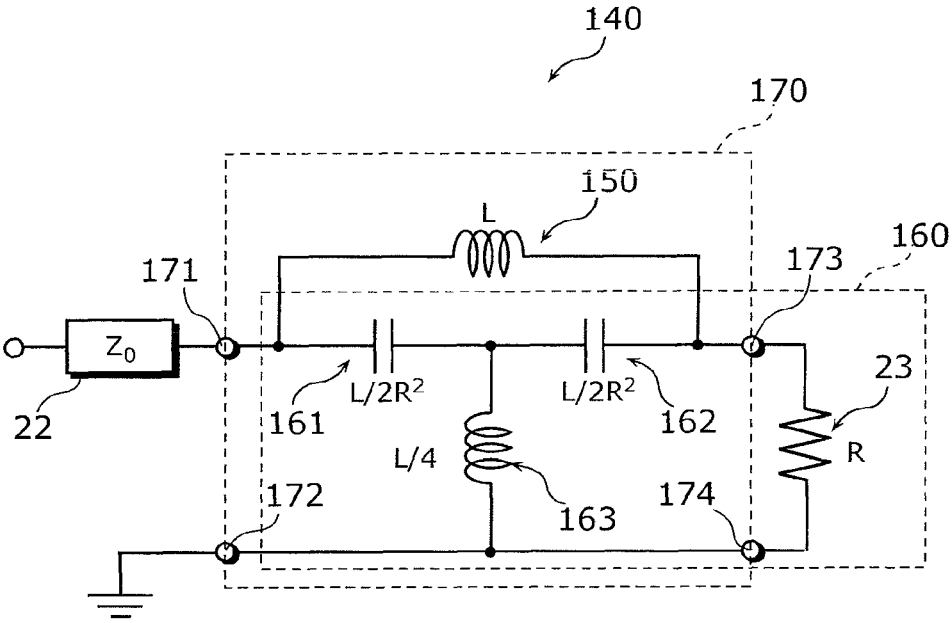
FIG. 8B is a second diagram schematically illustrating a circuit configured of a kicker magnet and an auxiliary circuit according to an embodiment of the present invention.

FIG. 8A and FIG. 8B are diagrams each schematically illustrating a circuit configured of the kicker magnet 150 and the auxiliary circuit 160 according to the present embodiment. As shown in FIG. 8A, the kicker magnet 150 is combined with the auxiliary circuit 160 so that a lumped constant circuit configured of a four-terminal circuit 170 and a terminating resistor 23 is constituted.

The four-terminal circuit 170 is a bridged-T four-terminal circuit configured of circuit elements Z1, Z2, Z3, and Z4. An input terminal 171 is connected to the output terminal of the pulse power supply 21 through the coaxial cable 22. An output terminal 173 is connected to one end of the terminating resistor 23. An input terminal 172 is grounded. An output terminal 174 is connected to the other end of the terminating resistor 23.

Further, in the four-terminal circuit 170, one end of the circuit element Z1 is connected to the input terminal 171, and the other end of the circuit element Z1 is connected to the output terminal. One end of the circuit element Z2 is connected to the input terminal 171, and the other end of the circuit element Z2 is connected to one end of the circuit element Z3. The one end of the circuit element Z3 is connected to the other end of the circuit element Z2, and the other end of the circuit element Z3 is connected to the output terminal 173. One end of the circuit element Z4 is connected to the other end of the circuit element Z2 and the one end of the circuit element Z3, and the other end of the circuit element Z4 is connected to the input terminal 172 and the output terminal 174.

Here, let R be the resistance value of the terminating resistor 23, let Z be the impedance of the circuit element Z1, let $Z_p$ be the impedances of the circuit elements Z2 and Z3, and let $Z_s$ be the impedance of the circuit element Z4. In this case, the input impedance $Z_{in}$ of the four-terminal circuit 170 can be expressed by the following equation (1).

[Equation 1]

$$Z_{in} = \frac{ZZ_p(2Z_s + Z_p) + R(Z_p(Z + Z_p) + Z_s(Z + 2Z_p))}{Z_p(Z + Z_p) + R(Z + 2Z_p) + Z_s(Z + 2Z_p)} \quad (1)$$

Here, when the condition (hereinafter, referred to as complete matching condition) expressed by the following equation (2) is met, the input impedance $Z_{in}$ is R.

[Equation 2]

$$Z_s + \frac{Z_p}{2} = R^2\left(\frac{1}{Z} + \frac{1}{2Z_p}\right) \quad (2)$$

Note that there are several possible solutions for $Z_s$ and $Z_p$ meeting the complete matching condition. Here, as an example, as shown in the following equation (3), the respective solutions for $Z_s$ and $Z_p$ are defined using the impedance Z of the circuit element Z1.

[Equation 3]

$$Z_s = \frac{Z}{4},\ Z_p = \frac{2R^2}{Z} \quad (3)$$

Here, as shown in FIG. 8B, assumed that the element circuit Z1 is the kicker magnet 150. Further, the circuit elements Z2 an Z3 are condensers 161 and 162, respectively. The circuit element Z4 is a coil 163. In this case, let L be the inductance of the kicker magnet 150. Further, based on the above equation (3), let $L/(2R^2)$ be the capacitances of the condensers 161 and 162, and let L/4 be the inductance of the coil 163. Further, when $Z_0$=R is the characteristic impedance of the coaxial cable 22, the input impedance $Z_{in}$ of the four-terminal circuit 170 can be R which is a constant value not depending on frequency. As a result, it is possible to obtain matching between the input impedance $Z_{in}$ of the four-terminal circuit 170 and the characteristic impedance $Z_0$ of the coaxial cable 22.

At this time, in the four-terminal circuit 170, frequency response characteristic of the pulsed current $I_m$ with respect to the pulsed voltage $V_0$ becomes a low pass frequency characteristic. The cutoff frequency is expressed as $\omega_c=2R/L$. Further, the pulsed current flowing through the kicker magnet 150 can be expressed as $I_m=V_0/R$.

In order for the pulsed voltage $V_0$ (where $V_0<40$ kV approximately) applied to the kicker magnet 150 to rise, switching delay time $t_s$ (where $t_s\approx25$ nsec approximately) is required which is necessary for switching the thyratron of the pulse power supply 21. Further, In order for the pulsed current $I_m$ to be transmitted to the kicker magnet 150, current transmission time expressed as $t_m=L/R$ is required. Based on these, rise time for a magnetic field to rise at the kicker magnet 150 is given by $t=t_s+t_m$.

Here, as an example, let $I_m=6$ kA be the pulsed current, let 50 nsec be rise time, and let $V_0=30$ kV be the pulsed output voltage. In this case, the resistance value of the terminating resistor 23 is given by $R<V_0/I_m\approx5\Omega$ approximately, and the inductance of the kicker magnet 150 is given by $L<R(t-t_s)\approx0.125$ μH approximately.

Figure 9:
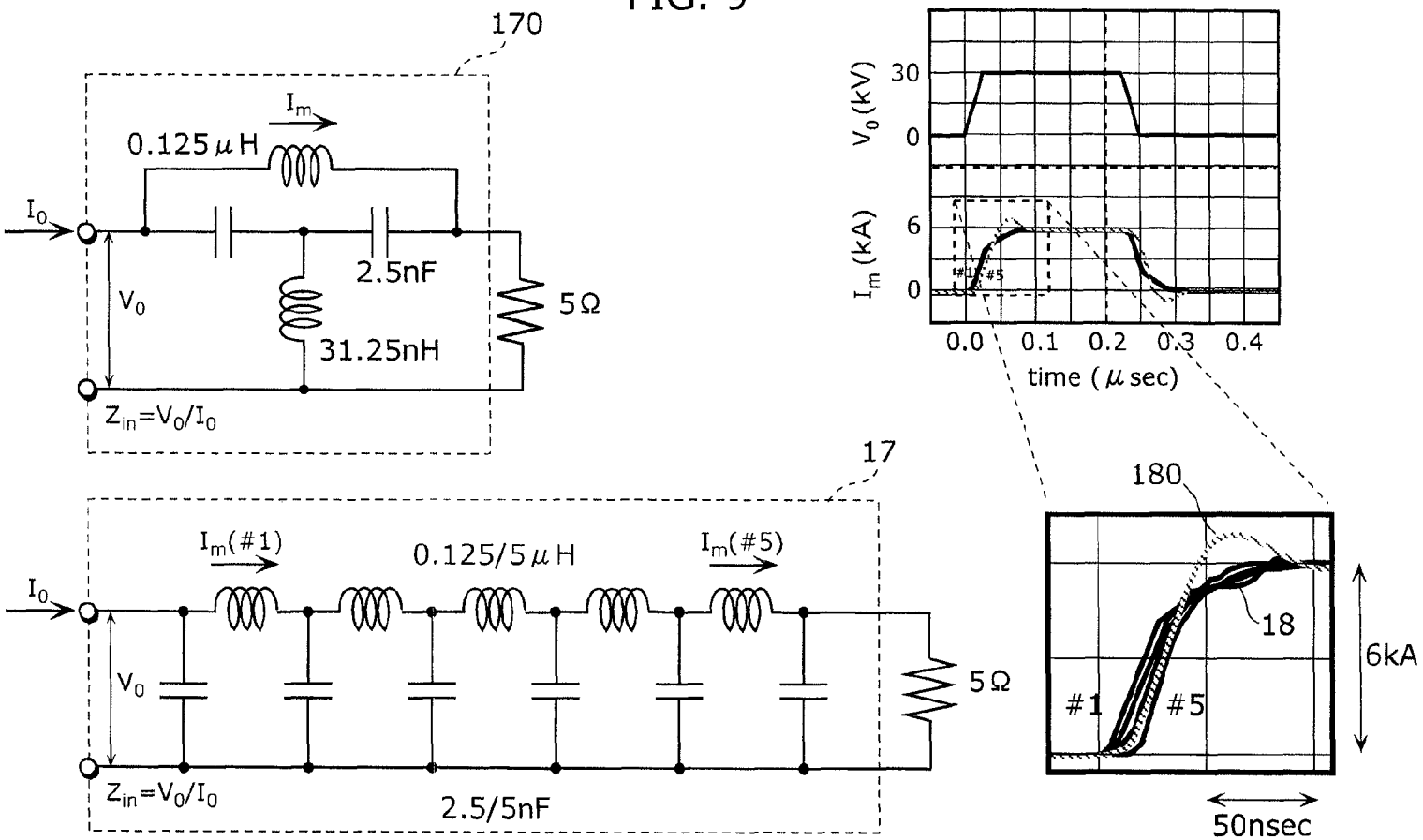
FIG. 9 is a diagram illustrating comparison of pulse responses between a kicker magnet according to an embodiment of the present invention and a conventional kicker magnet.

FIG. 9 illustrates comparison of the pulse responses between the kicker magnet 150 according to the present embodiment and the conventional kicker magnet 15. As shown in FIG. 9, here as an example, let 0.125 μH be the inductance of the kicker magnet 150, let 2.5 nF be the capacitances of the condensers 161 and 162, and let 31.25 nH be the inductance of the coil 163. In this case, when 30 kV pulsed voltage $V_0$ is applied from the pulse power supply 21 at the switching delay time 25 nsec, 6 kA pulsed current flows through the kicker magnet 150 at the rise time of 50 nsec (180 in graph). On the other hand, in the kicker magnet 15, it is shown that pulsed current sequentially flows through the magnetic cores, which are divided into five, and rises at 50 nsec (18 in graph).

In other words, with respect to the rise time, there is no marked difference between the two. As a result, instead of using the kicker magnet 15 with a complicated structure, use of the kicker magnet 150 with a simpler structure can also achieve the equivalent rise time.

Figure 10:
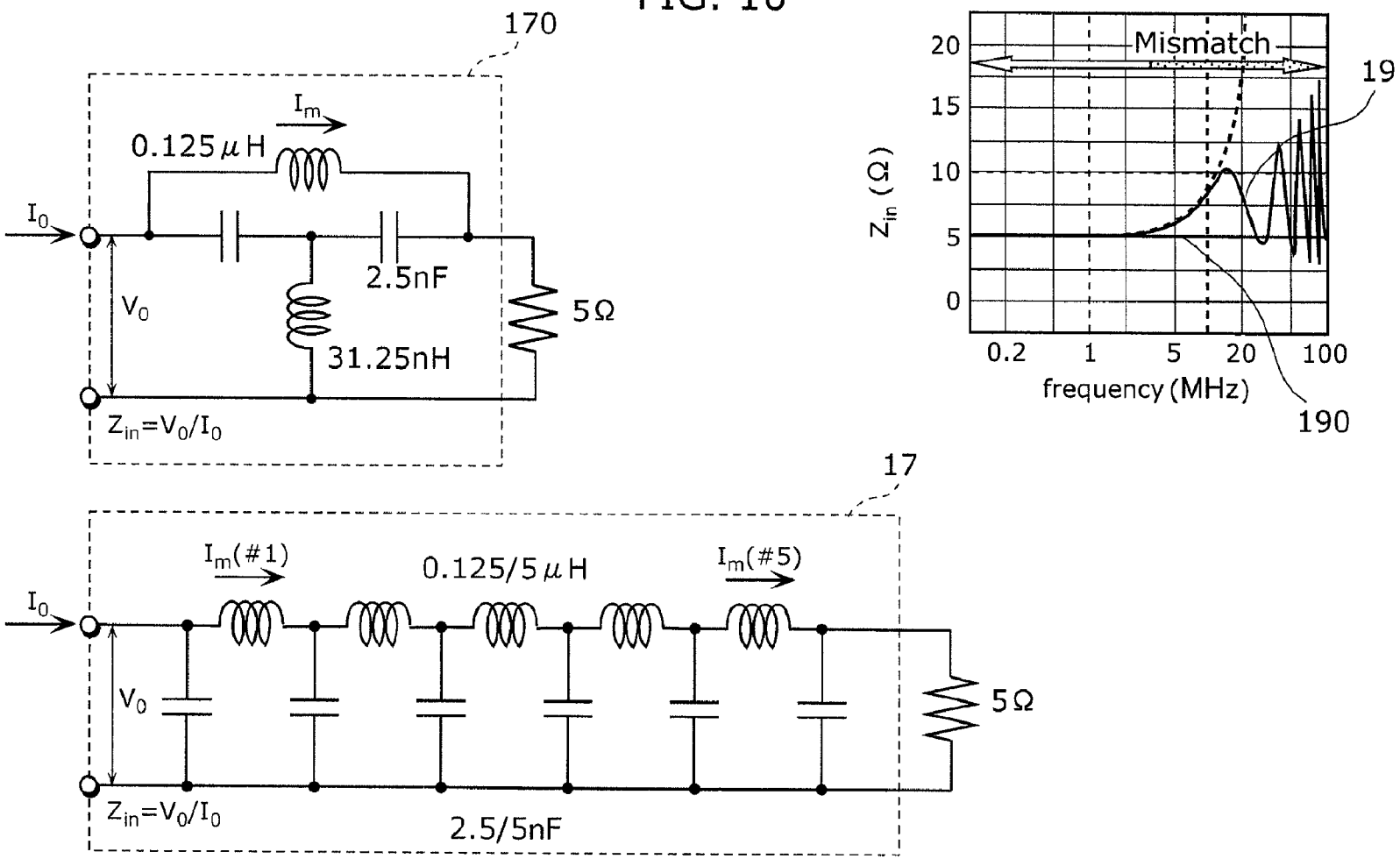
FIG. 10 is a diagram illustrating comparison of input impedances between a kicker magnet according to an embodiment of the present invention and a conventional kicker magnet.

FIG. 10 illustrates comparison of the input impedances between the kicker magnet 150 according to the present embodiment and the conventional kicker magnet 15. As shown in FIG. 10, the conventional kicker magnet 15 does not allow matching in higher bands than cutoff frequency since input impedance depends on frequency (19 in graph). However, the kicker magnet 150 according to the present embodiment allows constant impedance at 5Ω in all frequency bands by being combined with the auxiliary circuit 160 (190 in graph). This results in rarely causing destructive error due to reflection, and facilitates stable driving for a long period of time. As a result, maintenance work which involves radiation exposure can be reduced.

According to the fast electromagnet device 140 of the present embodiment, even though the kicker magnet 150 is designed as one of circuit elements constituting a lumped constant circuit, constant input impedance can be performed in principle in all frequency bands by combining the kicker magnet 150 and the auxiliary circuit 160. Therefore, a perfect matching can be performed between the four-terminal circuit 170 and the coaxial cable 22, which makes it possible to perfectly prevent reflection from occurring. Therefore, destructive failure due to reflection can be avoided as much as possible, stable driving for a long period of time can be expected, and maintenance work involving radiation exposure can be reduced.

Furthermore, the kicker magnet 150 and the auxiliary circuit 160 can be separately mounted. Therefore, it is possible to use a component which is inexpensive and large in size, as a circuit element for the auxiliary circuit 160. This facilitates production and selection of circuit elements, for example, easing of the conditions for withstanding voltage.

Furthermore, the kicker magnet 150 has a simpler structure compared to the kicker magnet 15, requires a significantly reduced number of components, and the design of the kicker magnet 150 itself can be greatly simplified.

Furthermore, the kicker magnet 150 does not require a vacuum case which is absolutely necessary for the conventional kicker magnet 15. This makes it possible to make effective use of the straight section of the ring of the circular accelerator 100, which is restricted in installation space. Furthermore, a component which requires very high level of precision, such as a terminal provided to the vacuum case, is not necessary. Moreover, since a magnetic core which causes deterioration of vacuum characteristics can be provided in the air, it is possible to maintain a high vacuum state of the ring of the circular accelerator in which the charged particle beams circulate, and to avoid unnecessary loss of the charged particle beams.

INDUSTRIAL APPLICABILITY

The present invention can be applied as a fast electromagnet device which applies a magnetic field generated by exciting an electromagnet instantaneously to a charged particle beam, so as to inject the charged particle beam into a circular accelerator, or to eject the charged particle beam from the circular accelerator.

The invention claimed is:

1. A fast electromagnet device which receives a high voltage pulse from a pulse power supply through a transmission line and excites an electromagnet at high speed, so as to bend a charged particle beam, said fast electromagnet device comprising:

an electromagnet which is formed with a space penetrating in a traveling direction of the charged particle beam, and instantaneously generates a magnetic field in the space with the high voltage pulse applied, so as to bend the particle beam passing through the space, said electromagnet being equivalent to a circuit element of a lumped constant circuit; and an auxiliary circuit which constitutes a matching circuit in combination with said electromagnet, so that an input impedance of the matching circuit and a characteristic impedance of the transmission line connected to an input terminal of the matching circuit are matched, wherein the matching circuit includes a bridged-T four-terminal circuit connected to the transmission line, a bridge of said bridged-T four-terminal circuit being a coil which constitutes said electromagnet.

2. The fast electromagnet device according to claim 1, wherein said electromagnet includes:

the coil having one end connected to the pulse power supply through the transmission line; and a magnetic core, and said auxiliary circuit includes:

a first circuit element having one end connected to the one end of the coil;

a second circuit element having one end connected to the other end of the coil;

a third circuit element having one end connected to the other end of said first circuit element and to the other end of said second circuit element; and a terminating resistor having one end connected to the other end of the coil, and having the other end connected to the other end of said third circuit element.

3. The fast electromagnet device according to claim 2, wherein, when a resistance value of said terminating resistor is R, and an impedance of said electromagnetic is Z, an impedance of said first circuit element is given by $2R^2/Z$, an impedance of said second circuit element is given by $2R^2/Z$, and an impedance of said third circuit element is given by Z/4.

4. A circular accelerator which accelerates a charged particle beam, said circular accelerator comprising:

a plurality of bending magnets arranged in a ring; and a fast electromagnet device according to claim 1, provided on a traveling path of the charged particle beam.

* * * * *